United States Patent [19]

Wolcott et al.

[11] Patent Number: 4,667,361

[45] Date of Patent: May 26, 1987

[54] PAINT ROLLER CLEANER AND REMOVER

[76] Inventors: Edward O. Wolcott; Raymond Croix, both of 4624 NW. 17th Pl., Gainesville, Fla. 32605

[21] Appl. No.: 758,781

[22] Filed: Jul. 25, 1985

[51] Int. Cl.[4] ..... A47L 13/02

[52] U.S. Cl. ..... 15/236 R; 15/104.04; 15/230.11

[58] Field of Search ..... 15/236 R, 230.11, 104.04

[56] References Cited

U.S. PATENT DOCUMENTS

| | | | |
|---|---|---|---|
| 2,439,873 | 4/1948 | Snyder | 15/236 R X |
| 2,761,165 | 9/1956 | Krzanowski | 15/236 R |
| 2,825,916 | 3/1958 | Basala | 15/236 R |
| 2,961,683 | 11/1960 | Meyer | 15/236 R |
| 3,019,467 | 2/1962 | Garrett | 15/236 R |
| 3,373,456 | 3/1968 | Dalton | 15/1 |
| 3,504,391 | 4/1970 | McCarty | 15/236 R |
| 3,707,740 | 1/1973 | Demers | 15/236 R |
| 4,287,631 | 9/1981 | Marrs | 15/105 |

FOREIGN PATENT DOCUMENTS

| | | | |
|---|---|---|---|
| 2721212 | 11/1978 | Fed. Rep. of Germany | 15/236 R |

*Primary Examiner*—Chris K. Moore

*Attorney, Agent, or Firm*—Charles A. Bevelacqua

[57] ABSTRACT

A tool for scraping paint from the nap of a roller and for providing a hand grip by which a paint roller can be slid off a mandrel which holds it on the paint roller handle. The tool is in the form of a cylindrical tube slit at one side and has an integral hinge opposite the slit so it can be opened into two semicylindrical halves.

The curved ends of the semicylindrical halves are used to scrape paint from the nap of the roller. A corresponding end of each half is formed with an inwardly extending flange so that the tool can be closed about a roller with the flange abutting the end of the roller. The tool is then used as a handle to slide the roller off the mandrel.

7 Claims, 3 Drawing Figures

PAINT ROLLER CLEANER AND REMOVER

BACKGROUND OF THE INVENTION

This invention relates to a device to effectively remove paint from a paint roller and for easily and efficiently removing the roller from the roller handle or holder.

Various devices have been previously disclosed for removing paint from rollers. Some of these are effective but require use of both hands of the person cleaning the roller so that it is difficult to operate the roller cleaner and hold the roller in position to be cleaned at the same time or else a separate device is required to hold the roller handle as shown in U.S. Pat. No. 3,373,456 to Dalton. The U.S. patent to Krzanowski, No. 2,761,165 is a device made of wire for use with rollers made of sponge material which would be of limited usefulness with nap type rollers in common use now. U.S. Pat. No. 4,287,631 to Marrs shows another wire type device which would be ineffective with very thick naps. None of these prior devices have provision for removing the roller from the roller handle. The U.S. patent to Meyer, No. 2,961,683 is a tong device for cleaning and removing the paint roller. It is relatively cumbersome and complicated and grips the roller in a squeezing action for removal. Gripping the roller for removal would tend to crush or deform it since it is a hollow, relatively fragile structure. Deformation of the roller core would tend to make it very difficult to slide it off the retaining means of the typical roller handle.

What is needed is a simple durable device applicable to a wide range of naps that is easy to use but will not damage the roller.

SUMMARY OF THE INVENTION

The present invention provides a one piece paint roller cleaner and remover which is simple and easy to use, relatively inexpensive, and is effective for both functions without danger of potential damage to the roller.

Paint rollers and holders or handles are well known and do not form any part of this invention. The invention will be described in relation to common forms of paint rollers and paint roller handles or holders but is not in any way limited thereto. Such a well known form of paint roller compromises a hollow cylindrical core of relatively rigid material to which is attached or adhered a nap or fabric to hold and distribute paint. A typical paint roller handle is made of a metal rod or wire with a hand grip at one end and at its other end a rotatable mandrel or roller support onto which a roller can be slipped The paint roller tool of this invention comprises a tubular member of larger diameter than the outer diameter of the core of a typical paint roller. The tubular member is slit at one side and has an integral hinge on the side opposite the slit so that it can readily be opened into two semicylindrical halves. Each half has an inwardly extending flange at a corresponding one of their ends. The flange extends inwardly to a diameter approximately equal to or very slightly greater than the inner diameter of the core of a typical paint roller. There can be a semicylindrical reinforcing rib or extension at the inner margin or edge of said flange. The other end of each semicylindrical half is cut off squarely and had a curved edge which is used to scrape paint from the roller nap. With the two halves of the device open to about a 180° position, the curved edge on one of the halves can be pressed firmly against the roller to scrape paint from the nap of the roller using the flanged end of the cylindrical body as a handle so that the user stays clear of paint and mess at all times. When it is desired to remove the roller from the handle, the device is held in one hand in a closed position surrounding one end of the paint roller and with the inner margin of the flange abutting the end of the roller core. The roller handle is held with the other hand and the roller slid off the handle. Again the hands need not touch the paint roller.

It is an object of the present invention to provide a paint roller cleaner and remover that is simple and easy to use yet thoroughly effective for its purpose.

It is another object of this invention to provide a paint roller cleaner which is effective to clean paint from a paint roller of a wide range of nap thicknesses.

It is another object of this invention to provide an effective, durable one piece device for cleaning and removing paint rollers.

Still another object of this invention is to provide a tool which will clean paint from a paint roller and which will facilitate the removal of the roller from a roller handle quickly and easily but will permit both these operations to be performed by a person without contact with paint on the roller.

Another object of this invention is to provide a paint roller cleaner and remover which will not damage the nap or the core of a paint roller.

Another object of this invention is to provide a paint roller cleaner and remover which is quickly and easily cleaned after use.

These and other objects, features and advantages of this invention will become apparent from the following description in conjunction with the accompanying drawings.

DESCRIPTION OF THE PREFERRED EMBODIMENT

Figure 1:
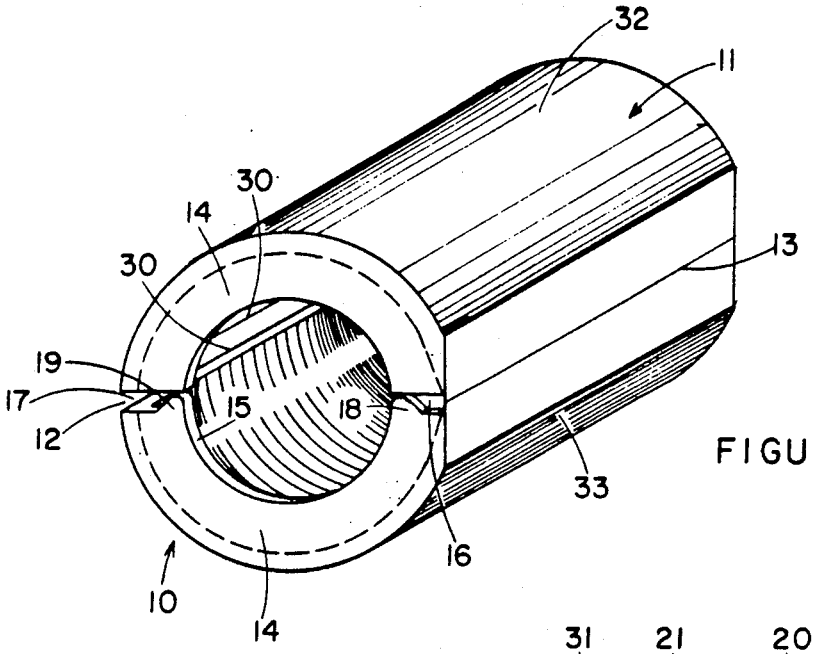
FIG. 1 is a perspective view of the tool of this invention in a closed position viewed from the flanged end.

Referring to the drawings, the paint roller cleaner and remover 10 comprises a hollow, generally cylindrical, relatively rigid body 11 which can be made of any suitable material such as a moldable plastic or a metal such as aluminum. The cylinder is slotted at one side as shown at 12 and a substantial amount of material is removed at the side opposite the slot to form a thin margin 13 which acts as a hinge. The body 11 is thus divided into two semicylindrical halves 32 and 33. A polyolefin, such as polypropylene, or other suitable moldable plastic has been found to be advantageous for the construction of the invention. These materials have good molding characteristics, provide a slick surface to which paint does not readily adhere and provide the desired strength and stiffness. Polypropylene appears to have a good balance of desirable properties. If the device is made of a metallic substance, a separate strip of plastic could be attached to form a hinge or some other form of hinge means provided. Both halves 32, 33 of the body may be provided at one end with an arcuate integral flange or collar 14 and an integral reinforcing rib or extension 15 at the inner diameter of the flange. Each of the flange portions extends just slightly less than a full semicircle. In addition, the flange on one of the halves has a clearance gap 16 adjacent the hinge and the flange on one of the halves has a clearance gap 17 opposite the hinge. The reinforcing rib extends across the gaps 16 and 17 and forms a tab 18 at the hinge side and a tab 19 at the side opposite the hinge. The clearance gaps help avoid stress concentration at the hinge and reduce the possibility of the two halves of the roller being adhered by paint which remains thereon for a long period of time. The tab 19 prevents close abutment of the long edges 30 for this same reason. The natural resilience of the integral hinge 13 provides a slight bias urging the tool to a relatively open position of the two halves so that the tool can be easily slid over a paint roller. The other end of each half is cut off squarely to provide an arcuate relatively sharp edge 34 approximately matching the outer diameter of a paint roller. The tool is of a length to provide sufficient leverage when used to scrape paint from a roller and to provide a suitable hand grip keeping the hands from contact with the paint roller when used to remove a roller from a handle. The inner diameter of the flange or of the reinforcing rib if one is used is approximately the same size or just slightly greater than the inner diameter of a roller core. The inner diameter of the reinforcing rib should not be more than one-sixteenth of an inch larger than the inner diameter of the core. A suitable length of the tool is about three and a half inches.

A typical paint roller handle, designated by the numeral 20 in the drawings, usually is constructed of a heavy wire or rod 21 which has a hand grip 29 at one end and an axle portion 31 on which is rotatably mounted a roller support or mandrel 22. Each end of the mandrel is closed and supported for rotation on the axle portion of the handle by an end cap 24 which may have a bearing or antifriction device as indicated by the numeral 28. The end cap at the free end of the mandrel is normally no greater than the diameter of the mandrel 22 but the end cap at the opposite end of the mandrel usually has a slight retaining bead 23 of a slightly larger diameter than the outer diameter of the core. A typical paint roller 25 consists of a hollow cylindrical core 26 having a suitable nap 27 for holding and spreading paint. The nap 27 may be of various types and thicknesses according to the type of paint to be used and the type of surface to be painted. The inside surface of the roller core 26 is a close fit with the outer surface of the mandrel 22 so that the core and roller are frictionally held on to the mandrel.

The roller is applied to a roller handle by sliding the core over the mandrel 22 until one end of the core abuts the retaining bead 26. Removal of the roller from the handle is best effected by pushing against the end of the core abutting the retaining bead with steady even pressure, causing the roller to slide off the mandrel. However, this is difficult to do by hand. Accumulation of paint between the roller core and the mandrel and dried paint between the ends of the roller and the end caps 24 make it difficult to remove the roller from the mandrel. Paint in the nap of the roller adds to the difficulty and unpleasantness of the job. Gripping the paint roller around its circumference to remove it tends to distort the roller and make it grip the mandrel more tightly. The distortion and gripping action are accentuated if a relatively thin gripping member is used to grip the roller. The roller is best removed by pushing it off the mandrel as described above.

OPERATION

Figure 2:
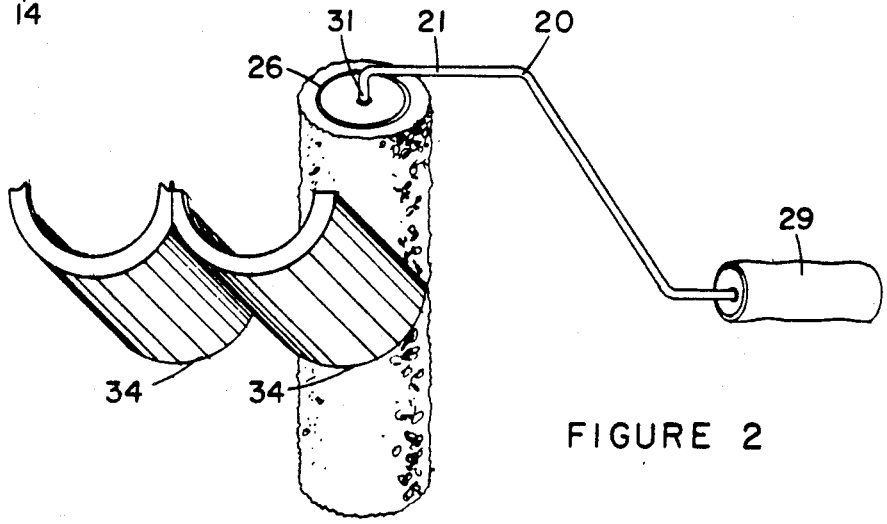
FIG. 2 is a perspective view showing the tool of this invention in the open position as it used to scrape paint from a paint roller on a handle.
Figure 3:
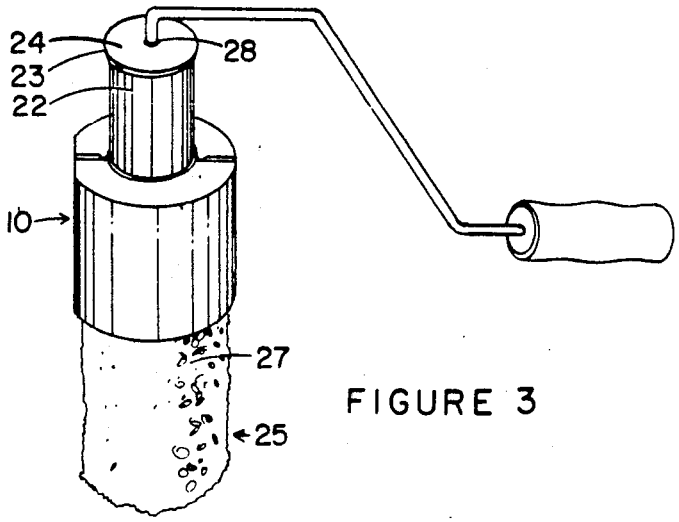
FIG. 3 shows the invention in a closed position about one end of a paint roller being removed from a paint roller handle.

In using the present invention the curved edge 34 of one of the semicylindrical halves of the tool are held firmly against the nap near one end of the roller with the tool in the open position as shown in FIG. 2. Using the flanged end of the tool as a handle the curved edge 34 is pressed against the roller nap and pushed down over the roller dispelling the paint from the nap and causing it to flow off the other end of the roller. This is repeated several times around the circumference of the roller until substantially all of the paint is dispelled from the roller. The tool is then moved so that the flange and reinforcing rib lie just above the core of the roller and the tool is closed about the roller as shown in FIG. 3. In this closed position of the tool, the inner diameter of the reinforcing flange will just clear the retaining bead 23 which may be on the roller mandrel. The wire or rod portion 21 of the roller handle is held in one hand, while the other hand tightly grips the tool and applies a force pushing the roller off the mandrel.

It is to be understood that the invention disclosed herein is not limited to the details of construction and arrangements of parts illustrated in the accompanying drawing but is capable of being practiced or carried out in various ways. Furthermore, the terminology employed herein is for the purpose of description and is not to be considered as a limitation.

It is obvious to those skilled in the art that although the invention has been shown and described in a preferred embodiment, many variations may be made in the form and structure here presented without departing from the scope of the present invention as set forth in the appended claims.

What is claimed is:

1. A paint roller cleaning and removal tool comprising a pair of substantially symmetrical semicylindrical elements of substantially greater length than diameter joined together by an integral hinge, said tool being effective to scrape paint from a portion of said roller when one end of one of said semicylindrical portions is pressed against the nap of a paint roller and moved lengthwise through said nap, the other semicylindrical portion of said tool and the other end of said one semicylindrical portion being used as a handle whereby the paint scraping action can be effected without coming in contact with paint on the roller, at least one of said semicylindrical portions having an integral arcurate flange extending inwardly therefrom, the tool being effective to remove a paint roller from a paint roller handle when said flange is positioned against one end of the core of the paint roller and the tool is moved in a direction to slide the paint roller from the paint roller handle.

2. A paint roller cleaning and removal tool as described in claim 1 in which said arcuate flange includes an arcuate integral reinforcing rib at its innermost circumference.

3. A paint roller cleaning and removal tool as described in claim 2 in which both of said semicylindrical portions are provided with a flange and reinforcing rib.

4. A paint roller cleaning and removal tool as set forth in claim 3 wherein said two semicylindrical portions may be pivoted on said hinge to form a substantially continuous cylinder the diameter of which will readily admit a paint roller and wherein said flange portions form a substantially continuous annular collar having an inner diameter of approximately the same diameter as the core of a roller whereby the tool may be positioned in its closed position about a paint roller with said annular collar positioned outside one end of the paint roller and the tool moved in a direction along the longitudinal axis of said cylinder to slide the paint roller from a paint roller handle.

5. A paint roller cleaning and removal tool as described in claim 4 wherein the two semicylindrical portions are of substantially equal length and of such length as to permit a person using the tool to remove a paint roller by the method described without coming in contact with the surface of the paint roller.

6. A paint roller cleaning and removal tool as set forth in claim 3 wherein at least one of said arcuate flange portions extends through an arc substantially less than 180°.

7. A paint roller cleaning and removal tool as set forth in claim 6 in which the integral reinforcing rib on said one of said flange portions is of greater arcuate extent than said one of said flange portions.

* * * * *